United States Patent [19]

Dardick et al.

[11] Patent Number: 4,748,892

[45] Date of Patent: Jun. 7, 1988

[54] ENERGY TRANSFER MULTI-BARREL GUN

[76] Inventors: David Dardick, 211 E. 70th St., New York, N.Y. 10022; John Matcovich, 65-15 38th Ave., Woodside, N.Y. 11377

[21] Appl. No.: 79,511

[22] Filed: Jul. 30, 1987

[51] Int. Cl.[4] ..... F41D 3/06; F41D 7/02; F41D 10/06

[52] U.S. Cl. ..... 89/13.05; 89/1.41; 89/33.01; 89/155

[58] Field of Search ..... 89/1.41, 13.05, 9, 126, 89/155, 22

[56] References Cited

U.S. PATENT DOCUMENTS

| | | | |
|---|---|---|---|
| 3,041,939 | 7/1962 | Dardick | 89/126 |
| 3,434,380 | 3/1969 | Dardick | 89/13.05 |
| 3,501,998 | 3/1970 | Dardick | 89/156 |
| 3,503,300 | 3/1970 | Dardick | 89/13.05 |
| 3,855,931 | 12/1974 | Dardick | 102/436 |
| 4,373,422 | 2/1983 | Washborn et al. | 89/1.41 |
| 4,708,049 | 11/1987 | Durant et al. | 89/1.41 |

*Primary Examiner*—David H. Brown

*Attorney, Agent, or Firm*—Alfred B. Levine

[57] ABSTRACT

A rapid rate of fire, multiple barrel gun employing triangularly shaped cartridges that are fed and ejected transversely to the barrels of the gun. Each barrel has its own separate feed and ejection system, that are driven in common in a synchronized but out-of-phase relationship to successively fire from the different barrels. During each cycle of feed, the cartriges are successively accelerated, then moved at constant speed, then decelerated, and monentarily stopped during firing. The common drive mechanism transfers energy from the feed being decelerated to a different feed being accelerated to more efficiently drive the plural feed and ejection mechanisms at high speed.

25 Claims, 3 Drawing Sheets

ENERGY TRANSFER MULTI-BARREL GUN

STATEMENT OF INVENTION

This invention generally relates to high rate of fire multiple barrel guns, and more particularly to such guns that employ triangularly shaped ammunition that are fed into and ejected from the gun in a transverse direction without any reciprocating movement of the ammunition.

BACKGROUND

A large family of patents of the same inventor, David Dardick, has disclosed the many advantages of gun structures employing triangularly shaped ammunition and transverse feed and ejection of the ammunition. Different features of such gun mechanisms are variously shown in his earlier U.S. Pat. Nos. 2,831,401; 2,865,126; 2,983,223; 3,446,111; 3,446,113; 3,467,276; 3,501,998; and 3,503,300.

His earlier U.S. Pat. No. 3,434,380 discloses such a gun that fires salvos of projectiles. And his earlier U.S. Pat. No. 3,855,931 discloses a triangularly shaped cartridge for such salvo firing guns; and his earlier U.S. Pat. Nos. 3,507,219; 3,568,599; and 3,572,248 disclose other features of triangularly shaped ammunition.

A multiple barrel high speed firing gun is disclosed in his earlier U.S. Pat. No. 3,041,939.

SUMMARY OF THE INVENTION

The present invention is directed to such multiple barrel guns employing triangularly shaped ammunition, and having extremely high rates of fire. Such guns may not only have multiple barrels but may be provided with multiple bores for each barrel for firing salvos of projectiles. According to the present invention, a four barrel gun, having three bores for each barrel, can therefore fire a total of twelve projectiles for each sequence of firing.

According to further features of the invention, each of the series of barrels is provided with its own separate feed and ejection system for the triangular ammunition, such that each barrel can be very rapidly fed with ammunition, fired, and the spent cartridges very rapidly ejected.

According to still further features of the invention, there is provided a common driving system for driving the plural separate ammunition feeds in a syncronous manner but in an out-of-phase relationship, whereby the firing through the series of different barrels is controlled sequentially.

To obtain the high speed feeding of the cartridges, they are fed at different speeds during each cycle of operation, including an initial accelleration, a constant speed, a decelleration, and a momentary dwell for firing. Since the different barrels are fired in time sequence, the drive system permits transfer of energy of one feed during its decellerating period to another feed during its accellerating period, thereby resulting in a higher efficiency drive system.

DETAILED DESCRIPTION OF PREFERRED EMBODIMENTS OF THE INVENTION

Figure 1:
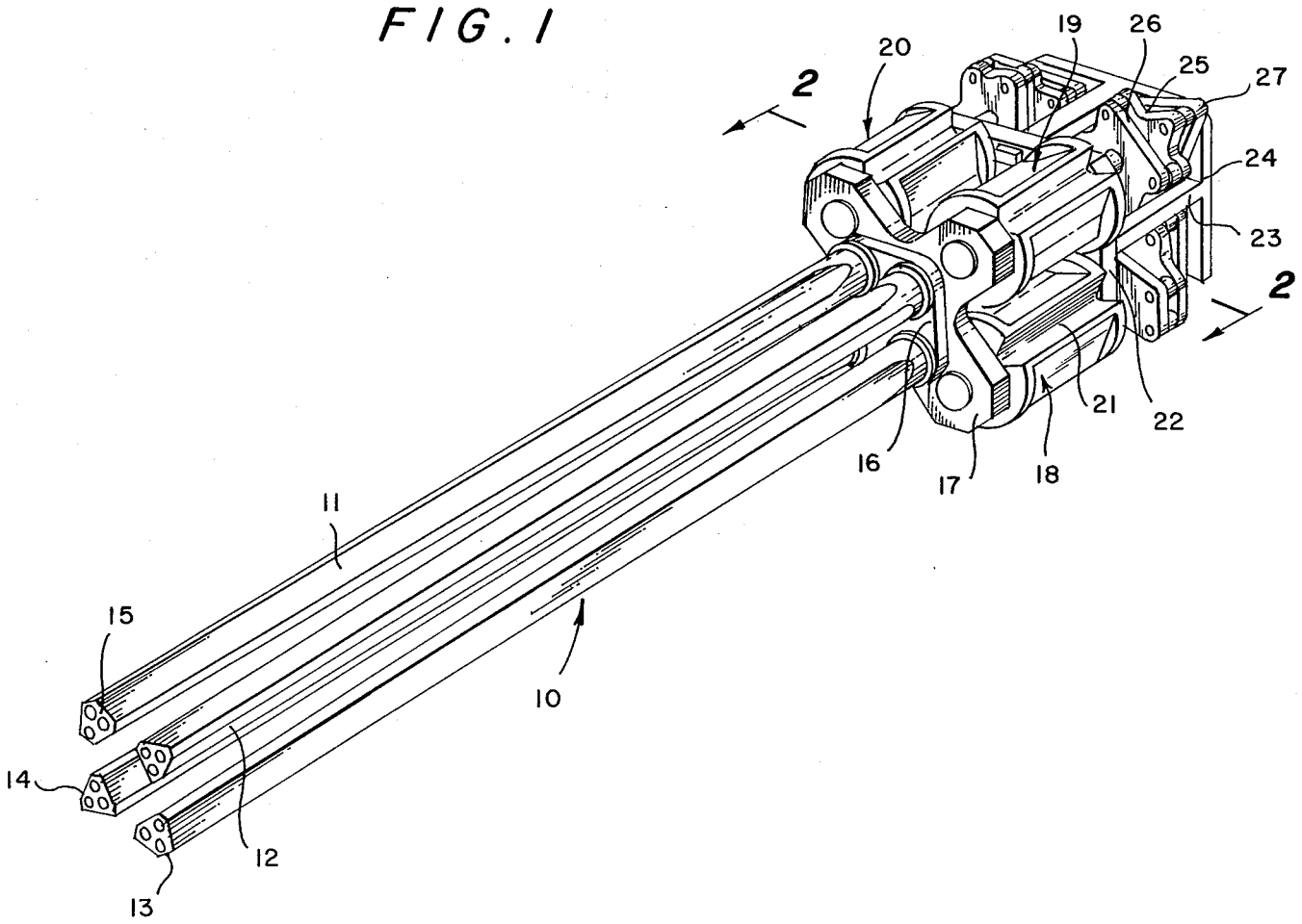
FIG. 1 is a perspective view showing portions of a four barrel gun, for firing salvos, according to the invention.

Referring to the drawings, there is shown in FIG. 1, a four barrel gun according to the invention, with each of the four fixed barrels 11, 12, 13, and 14 having three symmetrically arranged bores 15 to fire a salvo of projectiles. Upon firing through all four barrels, a total of twelve projectiles are therefore fired.

Figure 2:
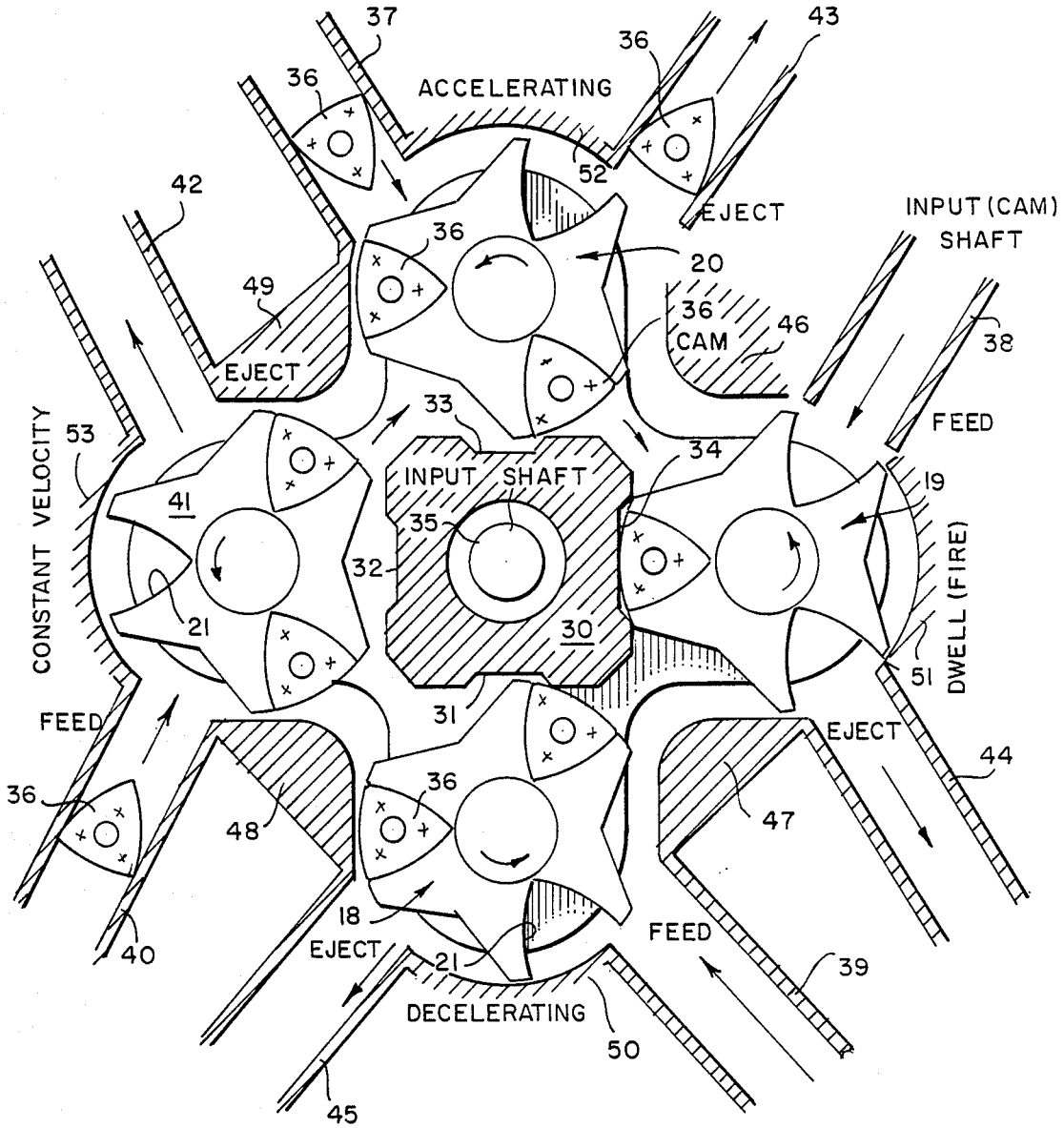
FIG. 2 is a cross sectional view taken along lines 2—2 of FIG. 1, and showing portions of the ammunition feed system.

Each of the four fixed barrels 11, 12, 13, and 14, has its own separate feed and eject mechanism for ammunition, including the four rotatable cylinders 18, 19, 20, and 41 (as also shown in FIG. 2), with a different feed cylinder four each barrel. These four cylinders 18, 19, 20, and 41 are rotatably driven by a common power source (to be described) to feed the ammunition to the barrels in a syncronized manner for firing but in an out-of-phase relationship.

FIG. 2 best illustrates the separate feed of ammunition to each of the barrels and the separate ejection of the spent ammunition or cartridges from each barrel after firing.

Referring to FIG. 2, the four rotatable feed cylinders 18, 19, 20, and 41 are disposed symmetrically about a central portion 30 of the fixed frame member, and supported by the frame for counterclockwise rotation, as shown by the arrows. Each cylinder is provided with three triangularly shaped cavities 21 that are each adapted to receive, retain, and eject after firing a triangularly shaped cartridge of ammunition 36, as shown in cross section. The cartridges are disclosed in detail in earlier patents of the inventor, including U.S. Pat. No. 3,855,931, and further details of these cartridges are not considered necessary in the present application. The fixed frame structure includes a separate ammunition feed channel structure for continuously feeding the triangular cartridges in rapidly moving serial order to each of the cylinders. For example, the uppermost cylinder 20 is provided with its own ammunition feed channel structure 37 for directing the feed of cartridges to the cavities in that cylinder 20. Similarly, feed channels 38, 39, and 40 are each provided to independantly feed cartridges to the other rotatable cylinders 19, 18, and 41, respectively.

In a similar manner, the frame structure provides an eject or outlet channel structure for each one of the cylinders, with each eject channel adapted to serially receive the spent cartridges after firing from a different one of the cylinders and convey the rapid stream of spent cartridges out of the gun at high speed. For example, the uppermost feed cylinder 20 is provided with its own eject channel structure 43, as shown; and eject channels 44, 45, and 42 are provided to convey ejected cartridges from feed cylinders 19, 18, and 41, respectively.

Continuing with reference to FIG. 2, each of the three trianularly shaped cavities 21 provided in each rotatable feed cylinder is open at the outside of the cylinder, as shown, so that each of the serially fed triangular cartridges passes transversely into the next available cavity of that associated cylinder, as that cylinder rotates past its associated feed channel. This enables a high speed stream of serially fed cartridges to be rapidly conveyed to each gun barrel by the rotating feed cylinder for that barrel, without any reciprocatory movement of the cartridges. Similarly, as each feed cylinder continues its rotation, each spent cartridge is ejected in a high speed serial stream, as each spent cartridge is rotated to the eject channel by the feed cylinder. For example, in FIG. 2, the upper feed cylinder 20 has just received a triangular cartridge 36 from its feed channel structure 37; and concurrently, the lowermost feed cylinder 18 is just about to eject a spent cartridge 36 out of its eject channel structure 45.

After feeding in cartridge 36 to the feed cylinder 20, the continuing counterclockwise rotation of feed cylinder 20 brings the cartridge 36 into a firing chamber that is aligned with a gun barrel associated with that feed cylinder. This is illustrated in FIG. 2 by the right hand feed cylinder 19 that has conveyed its cartridge 36 into a location confronting the outer surface 34 of the central frame member 30. At this location the cartridge is aligned with and in firing postion with the gun barrel (11 in FIG. 1), and the cartridge is located within a closed firing chamber formed by the wall 34 of frame 30 and by the two walls of the feed cylinder 19 that form the cavity accomodating the cartridge 36. In this closed firing chamber position, the cartridge is fired and its projectiles pass outwardly through the gun barrel 11 (FIG. 1). After firing of that cartridge, the continued rotation of the feed cylinder 19 conveys the spent cartridge 36 to its eject channel structure 44 where the spent cartridge is ejected from the gun. Concurrently, a preceeding empty cavity in the same feed cylinder is aligned with its feed channel 38, as shown, and is receiving a new cartridge. Thus, at the time that each cartridge is being fired, a preceeding cavity in the same feed cylinder 19 is ejecting its spent cartridge, and the next cavity of that same cylinder is receiving a fresh cartridge for future firing.

Briefly recapitulating the structure and mode of operation as thus far described, the four barrels of the gun 10 are symmetrically supported by the frame 30, and each barrel is provided with its own ammunition feed and ejection structure, including for each barrel, a rotating feed cylinder together with ammunition feed and eject channels for rapidly feeding triangularly shaped cartridges in a serial stream into and out of the firing chamber for each barrel. The feed cylinders for each barrel are provided with three triangularly shaped cavities that are open at the peripheral walls whereby the cartridges are fed and ejected transversely to the axis of rotation of the feed cylinders, without any reciprocating movement. A firing chamber for each barrel is formed by the two walls of each of the cavities in the feed cylinder confronting a mating surface of the central frame member of the gun.

As shown in FIG. 2, the four feed cylinders 18, 19, 20, and 41 are symmetrically supported about the frame for rotation about the periphery of the central portion of the frame member 30, with each having a firing chamber aligned with a different one of the four symmetrically arranged gun barrels, as best shown in FIG. 1.

Figure 3:
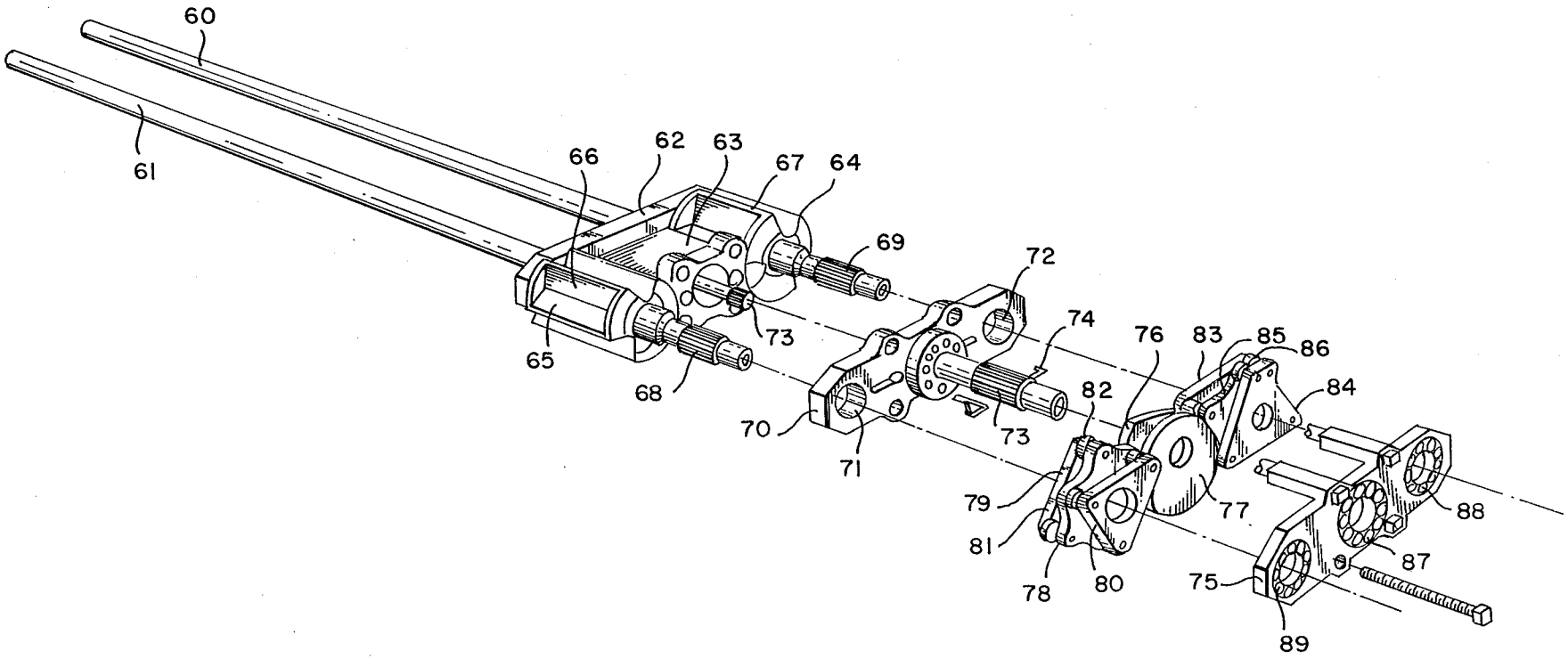
FIG. 3 is an exploded view, in perspective, showing details of a two barrel gun and a common drive for the ammunition feed system.

The four ammunition feed cylinders are driven in common by an input drive shaft 35 that is centrally positioned to rotate inside of the central frame member 30, as shown in FIG. 2. This drive shaft 35 is driven at high speed by an electrical drive motor (shown at 63 in FIG. 3), and the shaft 35 is coupled to drive the feed cylinders 18,19,20, and 41 by a conjugate cam and follower, as best shown in FIGS. 1 and 3 (to be described). This common drive system permits the four gun barrels to be fed with ammunition in a syncronized manner but in a desired out-of-phase relationship, thereby to minimize recoil, vibration, and to improve the efficiency of the drive system for the gun.

In a preferred embodiment, each of the four feed cylinders is driven by a separate pair of follower cams to rotate at varying accellerations and speeds during each cycle of rotation, as shown in FIG. 2. Referring to FIG. 2, the four feed cylinders are shown at one rotative position during a cycle of operation. At this time or position illustrated, the upper cylinder 20 is in an accellerating mode shortly after it has received a cartridge of ammunition 36 from its feed channel 37. This cartridge is rapidly accellerated in a counterclockwise direction toward the central portion 33 of the frame 30. As the cartridge 36 approaches the central frame 30, the feed cylinder is decellerated, as shown by the lowermost feed cylinder 18. And when the cartridge 36 is positioned alongside the central frame 30 (and in its firing chamber position), the feed cylinder is momentarily stopped for firing, as shown by the right hand cylinder 19. Thus each cartridge of ammunition is fed to its cylinder, rapidly accellerated for a fixed angular movement to a high speed, then rotated at this fixed high speed through the next angular movement; then decellerated as it approaches its firing chamber; and finally stopped at the firing chamber for a short dwell period where the cartridge is fired. Thereafter the continued rotation of each ammunition feed cylinder ejects the spent cartridge through its eject channel and concurrently receives a new cartridge from its feed channel.

These differing speed and accelleration modes are performed by the four ammunition feed cylinders 18, 19, 20, and 41, in syncronism, by the cams and cam followers driving the cylinders, as shown in FIG. 1, but out of phase, such that at any time or portion of the cycle, each of the cylinders is in a different speed or accelleration mode. For example, as shown in FIG. 2, when the upper cylinder 20 is accellerating, the lower feed cylinder 18 is decellerating; and the lefthand cylinder 41 is rotating at constant speed while the righthand cylinder 19 is at dwell for firing. Shortly thereafter, the righthand cylinder 19 will commence to accellerate in opposition to decellerating of the lefthand cylinder 41, while the upper cylinder 20 is in constant velocity, and the lower cylinder 18 is at dwell for firing its cartridge.

The exploded view of FIG. 3 best shows details of such a preferred cam drive system, but for one half of the four barrel gun of FIG. 1, or for a two barrel gun. As shown, a common input drive shaft 73, driven by an electric motor within housing 63, is provided at the center of the fixed frame 62 of the gun. The drive shaft 73 is coupled by an extension shaft having spur gear 74, to drive a pair of drive cams 76 and 77 located near the rear of the gun. A first pair of follower cams 79 and 80, at the left, engage with the two drive cams 76 and 77 to be driven thereby. These follower cams 79 and 80 are, in turn, coupled by a spur gear 68 to rotate the shaft driving the ammunition feed cylinder 65, for the left hand gun barrel 61.

In a similar manner, a second pair of follower cams 83 and 84, at the right, engages with the same pair of drive cams 76 and 77 to be driven thereby. The second follower cams 83 and 84, in turn, drive the shaft rotating the right hand feed cylinder 64, to feed ammunition to the second barrel 60 of the gun, through the spur gear 69.

The drive cams 76 and 77, together with the conjugate pairs of follower cams have their surface properly inclined and declined to provide the different accellerations, decellerations, constant speed, and dwell, of the ammunition feed cylinders as described above, but in opposition to one another. Thus as one feed cylinder is driven in its accelleration mode, the other is being driven in its decelleration mode. Similarly as one cylinder is being rotated in its constant speed mode, the other is in dwell for firing. In this manner, the energy being returned into the cam drive system by the decellerating cylinder is transferred to assist in accelerating the other ammunition drive cylinder, thereby improving the efficiency of the ammunition drive system for the gun.

In the four barrel gun of FIGS. 1 and 2, the structure and mode of operation is the same as in the two barrel system shown in FIG. 3 with opposing pairs of feed cylinders being oppositely accellerated and decellerated to transfer energy more efficiently. As shown in FIG. 1, the four sets of follower cams are all preferably driven by the same pair of drive cams, that is positioned in the center, with the four sets of follower cams symmetrically arranged around the drive cams, to be driven thereby in the same manner as shown in FIG. 3. According to the invention, the same drive system may be employed with different even numbers of gun barrels, each having its own ammunition feed system.

To syncronize the firing of the cartridges from each of the barrels at the proper syncronized times, the common drive shaft 73 (FIG. 3) is provided with a fixed firing cam 74 that sequentially triggers the firing of each of the cartridges for each of the feed cylinders at the proper time for each. A similar firing cam (not shown) is provided on the drive shaft for the four barrel gun of FIGS. 1 and 2, and it functions in the same manner.

As disclosed in Applicant's earlier patents above, the triangularly shaped salvo cartridges have symmetrically arranged projectiles therein that are always positioned in alignment with the multi-bore barrels of a salvo firing gun, as shown in FIG. 1. In one gun system according to FIG. 1, the input or drive shaft is rotated at a speed of 2000 RPM, thereby to feed and fire four cartridges for each revolution (one for each of the four barrels). This results in 8000 cartridges being fired during each minute. In the event that the gun is a salvo firing gun with three bores per barrel as shown in FIG. 1, a total of three projectiles are fired for each cartridge, resulting in a total of 24,000 projectiles being fired during each minute of operation of the four barrel salvo firing gun.

Many changes may be made in the preferred embodiments as described without departing from the spirit and scope of this invention. Accordingly, this invention is to be considered as being limited only by the following claims.

What is claimed is:

1. A multiple barrel gun comprising:

a central support frame, a plurality of gun barrels symmetrically supported peripherally about the central frame, a plurality of ammunition carrying cylinders symmetrically supported by the frame, each associated with a different barrel and in alignment with that barrel for firing ammunition therethrough in a given angular position of the cylinder, each cylinder having a plurality of triangularly shaped open sided cavities for accomodating a triangularly shaped cartridge of ammunition, cartridge guiding and ejecting means for feeding and ejecting said triangularly shaped ammunition into and out of the cavities in the cylinders in directions transverse to the axis of the gun barrels, the side walls of the cavities of each cylinder confronting a portion of the wall of the central frame member in a given angular position of each cylinder to form a closed firing chamber for each gun barrel, and driving means for rapidly rotating said plurality of cylinders in an out-of-phase syncronization to fire the ammunition in a time phased manner through the different gun barrels.

2. In the gun of claim 1, said driving means including nonuniform drive mechanism for rotating said cylinders during each revolution thereof in a programmed movement to rapidly accelerate each cartridge after feed, then to travel at constant speed, then to decellerate each cartridge into firing position, then to momentarily stop the movement of each cartridge during firing.

3. In the gun of claim 1, said driving means including energy transfer nonuniform drive mechanism for coupling a pair of cylinders to accelerate the rotation of one cylinder while decellerating the other, and transfer a portion of the energy of the decellerating cylinder to the accellerating cylinder.

4. In the gun of claim 1, said driving means including a cam and cam follower for driving the different ammunition carrying cylinders in an out-of-phase relationship, including driving one of said cylinders at an accelerating rate during a portion of each rotation while driving another cylinder at a decellerating rate during a portion of each rotation and transfering energy from the decellerating cylinder to the accellerating cylinder.

5. In claim 1, said gun having two barrels and two ammunition carrying cylinders, each feeding and ejecting from a different barrel.

6. In claim 1, said gun having four barrels and four ammunition carrying cylinders, each associated with a different barrel.

7. In claim 1, said gun having an even number of barrels and the same number of cylinders, each associated with a different barrel, and said drive means rotating pairs of said cylinders in an out-of-phase syncronized relationship to accellerate the feed of ammunition by one cylinder while decellerating the feed of ammunition by another cylinder, thereby to transfer energy from the decellerating cylinder to the accellerating cylinder.

8. In claim 1, at least one barrel of the gun having a number of bores adapted for firing a salvo of projectiles, and the triangularly shaped cartridges being fed to the cylinder associated with that multiple bore barrel containing a number of spaced apart projectiles adapted to be aligned with the different bores for firing of the salvo of projectiles.

9. A multiple barrel high rate of fire gun comprising:

a central frame member, plural barrels symmetrically supported by the frame, a rotatable cylinder for each barrel supported by the frame for receiving and accomodating ammunition to be fired and rotating the ammunition into a position coaxial with the associated barrel for firing and then to a displaced position for ejection of the spent ammunition, said cylinders provided with an open sided cavity constructed to receive and eject the ammunition transversely to the rotative axis of the cylinder, the walls of the cavity of each cylinder forming with a portion of the frame of the gun a firing chamber for each barrel when the cavity is angularly disposed in firing position with the barrel, drive means for rotating each cylinder in an out-of-phase synchronized manner, with each cylinder being accellerated, then driven at constant velocity, then decellerated, and then momentarily stopped for firing, all within each rotation of the cylinder.

10. In claim 9, said drive means being nonlinear and coupling pairs of cylinders for accelerating one of the cylinders while decellerating another of the cylinders and transfering energy from the decellerating cylinder to the accelerating cylinder.

11. In claim 9, said driving means including a cam and cam followers to drive each of the different cylinders.

12. In claim 9, said gun having four barrels and four cylinders each associated with a different one of the barrels, and at least one of the barrels having three bores for firing a salvo of projectiles.

13. In claim 9, the open sided cavity provided in each of the cylinders being triangularly shaped to accommodate a triangularly shaped cartridge containing a series of spaced apart projectiles, the barrels for said gun being provided with multiple bores that are spaced apart in correspondence with the spacing of the projectiles.

14. In claim 9, said gun having four barrels and four ammunition carrying cylinders each associated with a different barrel, each of the barrels having three symmetrically spaced apart bores, the open sided cavity in each cylinder being triangularly shaped for accomodating a triangularly shaped cartridge of ammunition, and each triangularly shaped cartridge having three projectiles that are symmetrically spaced apart corresponding to the spacing of the multiple bores in the gun barrels.

15. A multiple barrel gun for high rates of fire comprising:

a central support having a series of symmetrically arranged outwardly facing sides, a plurality of rotatable ammunition feed and eject cylinders peripherally disposed about the central support, each supported alongside a different one of the sides of the central support, each of the cylinders having a series of triangularly shaped cavities that are radially open at the outside to transversely receive and accomodate triangularly shaped ammunition, each of the cavities being rotated by its cylinder to successively confront an outwardly facing side of the central support to provide a closed firing chamber for the ammunition, a feed channel for each cylinder and an ejection channel for each cylinder for feeding and ejecting the triangularly shaped cartridges to and from each cylinder in a direction transverse to that cylinder when the cavities therein are aligned with the channels, a plurality of gun barrels corresponding in number to the number of cylinders, with the barrels supported peripherally about the central support, and with each barrel in closed communication with a different firing chamber, and drive means for driving said plurality of cylinders in a syncronized out-of-phase relationship, to successively permit firing of the ammunition through the different barrels.

16. In claim 15, said drive means including nonuniform drive mechanism for driving each cylinder during each rotation at varying rates, including an acceleration rate, a constant speed, a decelleration rate, and a dwell period for firing.

17. In claim 16, said drive means coupling said cylinders in pairs for driving one cylinder at an accelerating rate while driving another at a decellerating rate, and transfering energy from the decellerating cylinder to the accelerating cylinder.

18. In claim 17, said drive means including a common drive cam structure and a follower cam structure for each of the different cylinders.

19. In claim 18, each of said barrels having a plurality of bores, and said triangularly shaped ammunition containing a series of projectiles for firing salvos of projectiles through the different bores.

20. In claim 19, said common drive cam structure including a pair of interconnected drive cams and each of the follower cam structures including a pair of follower cams commonly engageable with the drive cams to provide the varying drive rates during each rotation of the cylinders.

21. A multiple barrel gun having a high rate of fire comprising:

a central support, a plurality of gun barrels peripherally retained by said support in a symmetrical arrangement, separate ammunition feed and ejection means for each barrel, said separate feed and ejection means including for each barrel a rotatable cylinder having a plurality of triangularly shaped cavities radially spaced about the cylinder, the cavities of each cylinder disposed to receive and eject a triangularly shaped cartridge in a direction transverse to the longitudinal axis of the gun barrel, and common drive means for rotating said plural cylinders in a syncronized but out-of-phase relationship to successively fire the ammunition through the different barrels.

22. In claim 21, said common drive means including a common drive cam, and cam followers for each cylinder, said drive cams and followers driving each cylinder at varying rates during each revolution, including an accellerating rate, a constant speed rate, a decellerating rate, and a momentary dwell time for firing.

23. In claim 21, said common drive means including nonlinear drive mechanism for coupling pairs of cylinders for the rotative movement of one cylinder while decellerating the movement of another and transferring energy from the decellerating cylinder to the accelerating cylinder.

24. In claim 21, each cylinder rotating about an axis parallel to its associated gun barrel, and in a given angular location positioning the ammunition within the firing chamber.

25. In claim 21, each barrel having multiple bores, and each triangularly shaped cartridge containing a like number of multiple projectiles to be fired in a salvo through the plural bores of the barrel.

* * * * *